United States Patent [19]

Susdorf et al.

[11] 4,130,065

[45] Dec. 19, 1978

[54] DUAL AXLE RAILWAY DRIVING TRUCK

[75] Inventors: Roman Susdorf; Ulrich Schüler; Heinz Engelmann, all of Berlin, Germany

[73] Assignee: Siemens Aktiengesellschaft, Munich, Germany

[21] Appl. No.: 669,805

[22] Filed: Mar. 24, 1976

[30] Foreign Application Priority Data

Mar. 27, 1975 [DE] Fed. Rep. of Germany ..... 2514265

[51] Int. Cl.[2] ..... B61C 3/00; B61C 9/50; B61C 9/52; H02K 1/17

[52] U.S. Cl. ..... 105/135; 105/131; 105/136; 105/137; 310/255

[58] Field of Search ..... 105/78, 135, 131, 132.1, 105/133, 136, 137; 188/164; 310/89, 91, 254, 255

[56] References Cited

U.S. PATENT DOCUMENTS

| | | | |
|---|---|---|---|
| 379,816 | 3/1888 | Ries et al. | 105/78 |
| 414,996 | 11/1889 | Ries | 188/164 |
| 3,602,153 | 8/1971 | Korn | 105/136 X |
| 3,626,862 | 12/1971 | Korn et al. | 105/132.1 X |
| 3,783,318 | 1/1974 | Widstrand | 310/254 X |
| 3,859,929 | 1/1975 | Korn et al. | 105/135 X |
| 3,867,654 | 2/1975 | Otto | 310/254 X |

FOREIGN PATENT DOCUMENTS

| | | | |
|---|---|---|---|
| 838452 | 65/1952 | Fed. Rep. of Germany | 105/135 |

*Primary Examiner*—Albert J. Makay
*Assistant Examiner*—Howard Beltran
*Attorney, Agent, or Firm*—Kenyon & Kenyon, Reilly, Carr & Chapin

[57] ABSTRACT

A drive for a railway track-bound propulsion vehicle includes a traction motor with output shafts on both sides. The motor is longitudinally arranged between two driving axles of a track-bound propulsion vehicle and is designed without a housing. In addition, the drive pinions are arranged directly on the rotor shaft which is supported in bearings in the transmission housing which also supports the stator of the traction motor. To take up the thermal expansion due to the different temperature rise of the stator and the rotor, at least one centering coupling which permits longitudinal displacement is provided in the train of the rotor shaft.

6 Claims, 3 Drawing Figures

DUAL AXLE RAILWAY DRIVING TRUCK

BACKGROUND OF THE INVENTION

The invention relates to the drive of a railway track-bound propulsion vehicle wherein an electric traction motor disposed between two driving axles drives each of the driving axles through a gear transmission. The pinion of the gear transmission is connected, through a coupling permitting longitudinal displacement, with one end of the rotor shaft and the transmission housing of the gear transmission is mounted at the stator of the traction motor. Such a drive is known from the German Pat. No. 838,452. In this drive, which has proven itself particularly for local traffic propulsion vehicles, the rotor shaft is supported in bearings on both sides in the end bell of the electric traction motor, while the drive pinion is supported in each case in the transmission housing. The transmission housing and the end bell or the stator housing are connected with each other; the traction motor therefore rests on the drive axles through the transmissions. A curved-tooth coupling is disposed between the drive pinion and the rotor shaft so that also longitudinal displacements relative to each other are possible and any present misalignment of the axes of the two separately supported shafts is compensated.

SUMMARY OF THE INVENTION

It is an object of the invention to achieve substantial savings in weight through integration of functions. According to a feature of the invention, the stator of the traction motor is configured, in a drive of the type described at the above, without a housing. The stator includes a stator lamination stack located between the pressure plates and clamped together by clamping elements at the back. According to a further feature of the invention, the lamination stack is supported on each side by the transmission housing in which the rotor shaft is also supported. At least on one end a centering coupling allowing longitudinal displacements is arranged between the rotor shaft and the bearing.

The end bells of the electric traction motor are therefore eliminated because the rotor carries the drive pinions directly on its shaft and is supported in the transmission housing. The interposed coupling ensures the centering of the rotor shaft. The function of the end bell is therefore assumed by the transmission housing which is brought up to the pressure plates of the stator lamination stack. In addition, the stator lamination stack of the motor is constructed without a housing and carries on its back clamping elements which compress the lamination stack and take up the occurring reaction moment to the torque. This design has the advantage of simplified construction and, connected therewith, considerable weight savings, which is important for the drives of self-propelled vehicles. Because the separate support of the rotor shaft is eliminated, a smaller distance between the driving axles is possible for the same power. The smaller space required, however, can also be utilized for a larger reduction ratio of the transmission.

Because during operation of the electric traction motor, the rotor and the stator have different temperatures and therefore, different thermal expansion, longitudinal movements are created between the two, which must be compensated. For this purpose a centering coupling is provided at least on one side, between the rotor shaft and the bearing, which permits longitudinal displacements. It is advisable to arrange this coupling on the commutator side of the traction motor. A particularly advantageous embodiment of such a coupling results in the taring disk, which is of necessity mounted on the rotor shaft, is provided with elastic arms and the latter are connected with a shaft stub carrying the drive pinion. In this case, the longitudinal movements are taken up by elastic material deformation.

Further unification of all components is obtained if a centering coupling which permits longitudinal displacements is arranged on both sides of the rotor shaft and means are provided which return the rotor shaft to the magnetic center. In this manner, the rotor shaft is centrally supported between the two output elements, floating under pretension, both shaft ends being of identical design. Pretensioning by the means for return guidance, particularly cup springs, makes it possible to equalize length changes of the rotor shaft due to temperature influences.

Although the invention is illustrated and described herein as a drive for a track-bound propulsion vehicle, it is nevertheless not intended to be limited to the details shown, since various modifications may be made therein within the scope and the range of the claims. The invention, however, together with additional objects and advantages will be best understood from the following description and in connection with the accompanying drawings.

DESCRIPTION OF THE PREFERRED EMBODIMENT OF THE INVENTION

Figure 1:
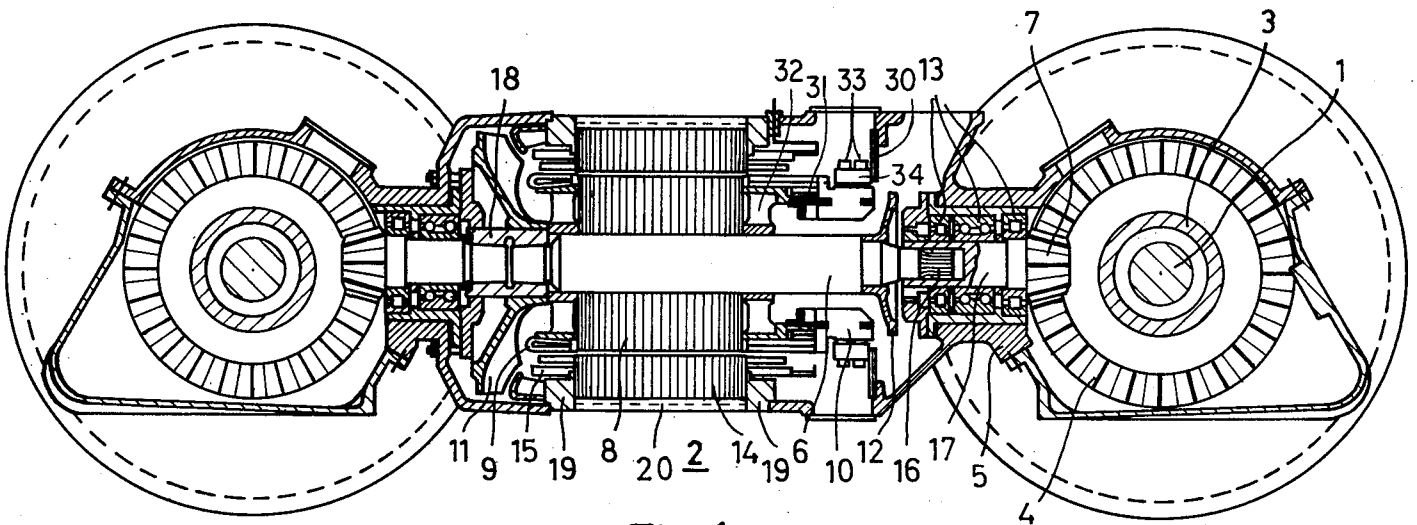
FIG. 1 shows a longitudinal cross-section of a drive of a railway track-bound propulsion vehicle according to a preferred embodiment of the invention.

In a railway track-bound propulsion vehicle for local traffic, two driving axles 1 are driven by an electric traction motor 2 which is arranged between them in the longitudinal direction of the propulsion vehicle. To this end, each driving axle 1 is surrounded by a hollow shaft 3, which carries the large gear 4 of a miter gear transmission. The connection between the hollow shaft 3 and the driving axle 1 is established in a manner known per se via couplings, not shown. The transmission housing 5 is likewise supported on the hollow shaft 3.

The electric traction motor 2 drives both driving axles 1 simultaneously. For this purpose, the rotor shaft 6 carries at each end the drive pinion 7 of the miter gear transmission. On the rotor shaft 6, there is further arranged the rotor lamination stack 8 with the rotor winding 9, as well as a ventilator 11 and a taring disk 12. The rotor shaft 6 is supported in bearings in the transmission housing 5. Bearing means in the form of antifriction bearings 13 on either side serve this purpose. Because of the miter gear transmission, the bearing support is designed on both sides of the rotor shaft 6 as fixed bearings. The electric motor 2 is also provided with a commutator 10 whose laminations are supported by shrinkage rings 31 and connected thereby to a winding support 32. Support 32, in turn, is supported on rotor shaft 6 and rotates therewith. Stationary brushes 33 are arranged in stationary supports 34 so as to glide on the surface of the commutator 10. The supports 34, in turn, are connected to support rings 30 which are connected to the motor housing.

Because during operation of the electric traction motor 2, the rotor lamination stack 8 with the rotor winding 9 generally heats up more than the stator lamination stack 14 with the stator winding 15, a change of length of the rotor shaft 6 occurs relative to the stator of the traction motor 2. So that this length change of the rotor shaft 6 does not endanger the meshing of the gears of the miter gear transmission and the bearing support designed as fixed bearings of the rotor shaft 6, a centering coupling 16, which permits longitudinal displacements, is provided on the side of the commutator 10 in the train of the rotor shaft 6, for example, a centering spline coupling. For this purpose, the rotor shaft 6 carries the inner part of the coupling 16, while the outer part of the coupling is constructed as a shaft stub 17 on which the drive pinion 7 is arranged. At the other end face of the traction motor 2, the drive pinion 7 is connected directly with the rotor shaft 6. In order to facilitate the assembly, however, this connection is made detachable, namely, by means of the shrink bushing 18.

To save weight, the stator of the electric traction motor 2 is made without housing. For this reason, the stator lamination stack 14 clamped between pressure plates 19 is provided at its back with clamping elements 20 which compress the stator lamination stack 14, thereby enabling the reaction moment to the torque of the electric traction motor 2 to be transferred by the elements 20 via the plates 19 to the transmission housing 5 where it is taken up. The transmission housing 5 is fastened immediately at the pressure plates 19. The latter therefore support the stator of the traction motor 2. Separate end bells of the electric traction motor 2 are thus eliminated and the transmission housing 5 serves for supporting the rotor shaft 6 with the drive pinion 7 as well as the stator lamination stack 14 with the pressure plates 19 and the stator winding 15.

The transmission housings 5 fulfill several functions, whereby the design of the drive is greatly simplified. Thereby, a shorter distance between the two driving axles 1 can be achieved with the same power of the traction motor. In addition, also facilitated by the design of the electric traction motor 2 without a housing, a substantial saving in weight is achieved which is very advantageous particularly for propulsion vehicles because then the useful load capacity of the propulsion vehicle can be increased accordingly.

Figure 2:
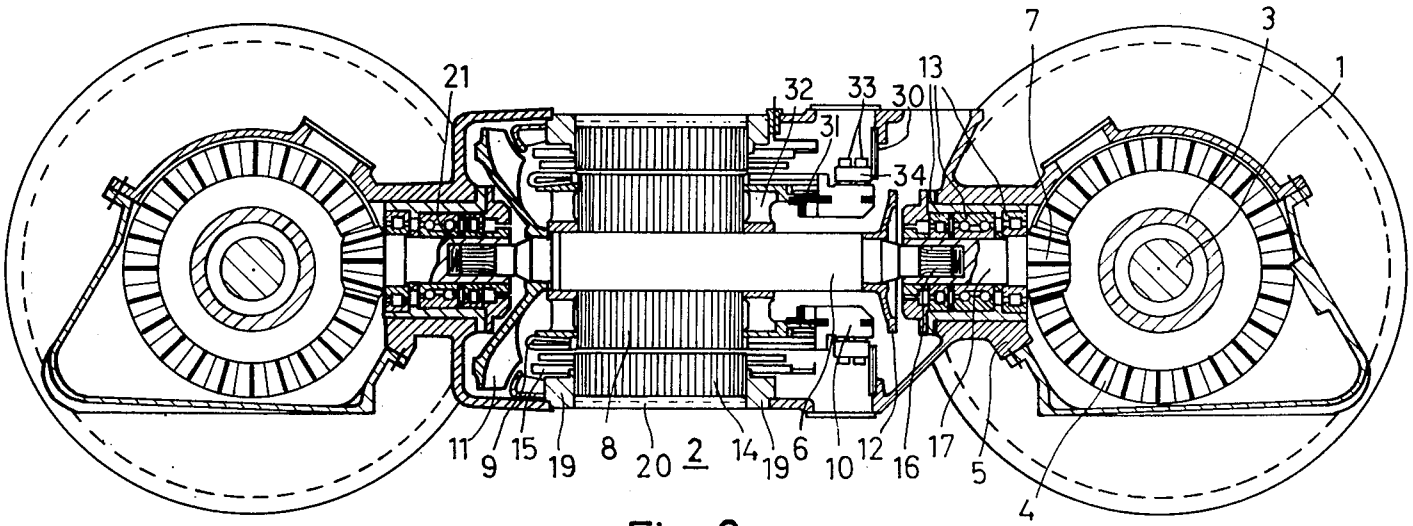
FIG. 2 illustrates a modified embodiment of the drive of FIG. 1 wherein centering couplings are arranged on both sides of the motor of the drive.

A somewhat modified embodiment example of the invention is shown in FIG. 2. For parts which agree with those of FIG. 1, the same reference numerals are used.

In this embodiment of the invention, a centering coupling 16 which permits longitudinal displacement is arranged on both sides of the traction motor 2 between the rotor shaft 6 and the antifriction bearings 13. The drive pinions 7 are therefore supported by a shaft stub 17 which forms the outer part of the centering coupling 16 and on which the antifriction bearings 13 are arranged. The rotor shaft 6 forms at its respective ends the inside part of the coupling 16. Thereby, the rotor shaft 6 is always centered in the shaft stubs 17. In addition, cup springs 21 which are under pretension, are arranged between the inner part of the coupling, connected with the rotor shaft 6, and the shaft stub 17 carrying the drive pinion 7. The rotor shaft 6 is therefore supported floating under pretension between the two drive elements. The pretension of the cup springs 21 is now in a position to compensate for length changes due to the higher temperature rise of the rotor as compared to the stator, which occurs during the operation of the electric traction motor 2. In this manner, the rotor is always returned to the magnetic center.

This design has the advantage that the two ends of the rotor shaft 6 and the shaft stubs 17 with the drive pinions 7 as well as their bearings are of the same design. Thereby, a unification of all components is obtained, which is of advantage from a manufacturing point of view.

Figure 3:
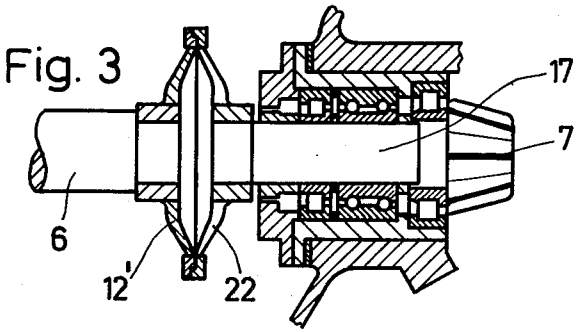
FIG. 3 illustrates in partial form a further modified embodiment of the drive of FIG. 1 wherein the connection of the taring disk of the drive has been modified.

A further embodiment example of the invention is shown in FIG. 3. Here the taring disk designated as 12, mounted on the rotor shaft 6 is provided with elastic arms 22 which are connected with the shaft stub 17 carrying the drive pinion 7. These arms 22 take up longitudinal movements by elastic material deformation.

What is claimed is:

1. A drive for a track-bound propulsion vehicle equipped with two drive axles comprising:

an electric drive motor disposed between the two drive axles and having a stator and a rotor equipped with a rotor shaft;

said stator including: a lamination stack, tension members arranged at the surface of said stack facing away from said rotor for tension holding said stack and pressure plates arranged at the respective longitudinal ends of said lamination stack for holding the same therebetween;

gear transmissions for transferring the torque energy developed by the drive motor to the drive axles respectively;

each of said gear transmissions including: a transmission housing, a pinion member coupled to said rotor shaft and operatively engaging the corresponding drive axle, and bearing means for bearing said pinion member and said rotor shaft in said housing;

said transmission housings including means for engaging and supporting the pressure plates at said longitudinal ends of said lamination stack, whereby said lamination stack is supported longitudinally between and by said transmission housings;

and at least one centering coupling means, said coupling means being disposed between one of said bearing means and the corresponding end of the rotor shaft for slidably connecting the one pinion member associated with that one bearings means to said corresponding rotor shaft end to permit a longitudinal displacement of the rotor shaft relative to said one pinion member.

2. The drive of claim 1, further including a coupler for detachably coupling the other of said pinion members directly to the other end of said rotor shaft.

3. The drive of claim 2 wherein said motor includes a commutator arranged between said coupling means and said lamination stack.

4. The drive of claim 1, wherein said one pinion member includes a shaft stub and a pinion mounted on said shaft stub; said coupling means including a taring disk mounted on said rotor shaft, and a plurality of elastic arms connecting said taring disk to said shaft stub.

5. The drive of claim 1, further including a second centering coupling means identical to said one centering coupling means and arranged between the other of said bearing means and the corresponding other end of the rotor shaft for slidably connecting the pinion member associated with that other bearing means to said other rotor shaft end, each of said centering coupling means including guide means for guiding said rotor shaft so that said rotor is centered with respect to the magnetic center of said stator.

6. The drive of claim 5, wherein said pinion members each include a shaft stub and a pinion mounted on said shaft stub, each of said guide means being cup springs disposed between their corresponding end of the rotor shaft and their corresponding shaft stub.

* * * * *